US005566995A

United States Patent [19]

Jagiela

[11] Patent Number: 5,566,995

[45] Date of Patent: Oct. 22, 1996

[54] DOOR SECURITY SYSTEM

[75] Inventor: Walter J. Jagiela, Merrillville, Ind.

[73] Assignee: Mercury Enterprises, Inc., Hammond, Ind.

[21] Appl. No.: 430,877

[22] Filed: Apr. 28, 1995

[51] Int. Cl.[6] ..... E04B 17/00

[52] U.S. Cl. ..... 292/346; 292/340

[58] Field of Search ..... 292/346, 340

[56] References Cited

U.S. PATENT DOCUMENTS

| | | | |
|---|---|---|---|
| 277,398 | 5/1883 | Wise . | |
| 325,846 | 9/1885 | Littlefield . | |
| 1,473,494 | 11/1923 | Miely . | |
| 1,653,487 | 12/1927 | White . | |
| 2,717,064 | 9/1955 | Hock | 189/46 |
| 3,767,245 | 10/1973 | Keefe | 292/340 |
| 3,815,945 | 6/1974 | Lamphere | 292/340 |
| 3,888,530 | 6/1975 | Fabrici | 299/346 X |
| 3,963,269 | 6/1976 | Rosenberg | 292/346 |
| 4,057,275 | 11/1977 | La Beaud | 292/340 |
| 4,070,074 | 1/1978 | Rohme | 312/245 |
| 4,130,311 | 12/1978 | Sushan | 292/346 |
| 4,171,837 | 10/1979 | McRoy | 292/346 |
| 4,178,588 | 12/1979 | Queren | 292/346 X |
| 4,186,954 | 2/1980 | Detlefs | 292/340 |
| 4,195,870 | 4/1980 | Percoco | 292/340 |
| 4,580,824 | 4/1986 | Asp | 292/340 |
| 4,607,510 | 8/1986 | Shanaan et al. | 70/95 |
| 4,635,399 | 1/1987 | Gehrle et al. | 292/346 X |
| 4,690,445 | 9/1987 | Hartley | 292/346 X |
| 4,717,185 | 1/1988 | Hartley | 292/340 |
| 4,770,452 | 9/1988 | Petree, Jr. | 292/340 |
| 4,844,521 | 7/1989 | Langenbach et al. | 292/143 |
| 4,854,622 | 8/1989 | Lozano | 292/340 |
| 4,865,370 | 9/1989 | Francis | 292/340 |
| 4,872,717 | 10/1989 | McEvoy et al. | 292/340 |
| 4,953,901 | 9/1990 | Hegdahl | 292/340 |
| 5,016,930 | 5/1991 | Hamilton | 292/340 |
| 5,024,475 | 6/1991 | Francis | 292/340 |
| 5,031,946 | 7/1991 | Yarrow | 292/337 |
| 5,070,650 | 12/1991 | Anderson | 292/340 X |
| 5,088,780 | 2/1992 | Doherty | 292/346 |
| 5,344,198 | 9/1994 | Elliott | 292/340 |

FOREIGN PATENT DOCUMENTS

| | | |
|---|---|---|
| 2623552 | 5/1989 | WIPO . |
| WO91/08364 | 6/1991 | WIPO . |

*Primary Examiner*—Rodney M. Lindsey
*Attorney, Agent, or Firm*—Marshall, O'Toole, Gernstein, Murray & Borun

[57] ABSTRACT

A security device for securing a hinged door against forcible opening is disclosed. The apparatus includes an interior plate portion secured to an inner side of the door frame. The interior plate portion defines a first edge disposable in a gap between a latch edge of the door and a latch receiving portion of the door frame. When installed in a door apparatus, the security device prevents the door from being forcibly opened even if the latch receiving portion of the door frame is damaged or the door is bowed or bent inward. An alternative embodiment of the security device includes a latch plate reinforcing portion and a clamping portion in addition to the interior plate portion. A kit is disclosed that includes the interior plate portion and screws for attaching the interior plate portion to the door frame and for reinforcing the door hinge.

20 Claims, 2 Drawing Sheets

DOOR SECURITY SYSTEM

BACKGROUND OF THE INVENTION

1. Field of the Invention

The invention relates generally to doors and door frames and, in particular, to an apparatus for securing a hinged door in a closed position.

2. Description of Related Technology

Typically, exterior doors of residences and commercial buildings are secured in a closed position by a latch mechanism that may include a doorknob latch and/or a dead bolt on one edge of the door and a hinge mechanism on an opposite edge of the door, secured to a door frame. Also typically, these exterior doors open by swinging inwardly about the hinge mechanism into the dwelling or building. One drawback of such an arrangement is that the door can be forcibly opened by prying the door away from the door frame at the latch edge of the door or by forcibly striking the door (e.g., kicking the door) in order to cause the latch mechanism and/or a portion of the door frame that receives the latch mechanism to fail.

Also, when the door is forcibly struck or kicked, fit may bow or bend inward, thereby pulling the doorknob latch and/or the dead bolt away from the door frame. In extreme cases, the door may bow or bend to a sufficient extent to cause the doorknob latch and/or the dead bolt to completely disengage from the portion of the door frame that receives the latch and/or dead bolt.

In many buildings and residences, the door frame is constructed of wood and can fail due to the force applied by kicking or prying the door open. Furthermore, in some door frames, the latch mechanism of the door engages a door jamb, mounted between the door frame and the door, that is weaker still than the door frame. Therefore, there is a need for a simple yet effective device to reinforce a door frame to guard against unauthorized entry.

A number of devices have been developed in order to secure a hinged door against unauthorized entry. Many of these devices include structure to reinforce the door frame or door jamb in a portion of the door frame or door jamb that receives the door latch and the dead bolt.

For example, Hamilton U.S. Pat. No. 5,016,930 (May 21, 1991) discloses a security device for installation in a door frame beneath a strike plate that receives a latch bolt. The security device includes a flat bar disposed vertically within the door frame. Fasteners at either end of the bar pass through the bar in a direction perpendicular to the plane of the door and extend into the door frame, and thereby secure the bar against the door frame. When the door is closed and locked, the bar engages the latch bolt or latch to secure the latch bolt or latch in a receptacle in the door frame.

One disadvantage of existing devices of the type described above is their inability to secure a door from opening if the door is bowed or bent away from the door frame. Also, these devices do not provide any means for strengthening the attachment between the hinges and the door or door frame.

SUMMARY OF THE INVENTION

It is an object of the invention to overcome one or more of the problems described above.

According to the invention, a security device for use in combination with a door apparatus including a door frame, a door, a latch, and a hinge is provided. The door frame includes an inner side and a latch receiving portion, and the door includes a latch edge partially containing the latch. The latch edge and the latch receiving portion define a gap therebetween when the door is in a closed position. The security device includes a door frame reinforcing member having a substantially planar interior plate portion disposable on the inner side of the door frame. The interior plate portion defines a first edge and extends from the door frame into the gap such that the first edge is disposed in the gap when the interior plate portion is disposed on the inner side of the door frame. The security device also includes means for securing the interior plate portion to the door frame.

The invention also comprehends a security device kit including the door frame reinforcing member and means for securing the interior plate portion to the door frame, and may further include means for securing a hinge to a hinge edge of the door and to a hinge receiving portion of the door frame.

Other objects and advantages of the invention will be apparent to those skilled in the art and from the following detailed description, taken in conjunction with the drawings and the appended claims.

DETAILED DESCRIPTION OF THE INVENTION

Figure 1:
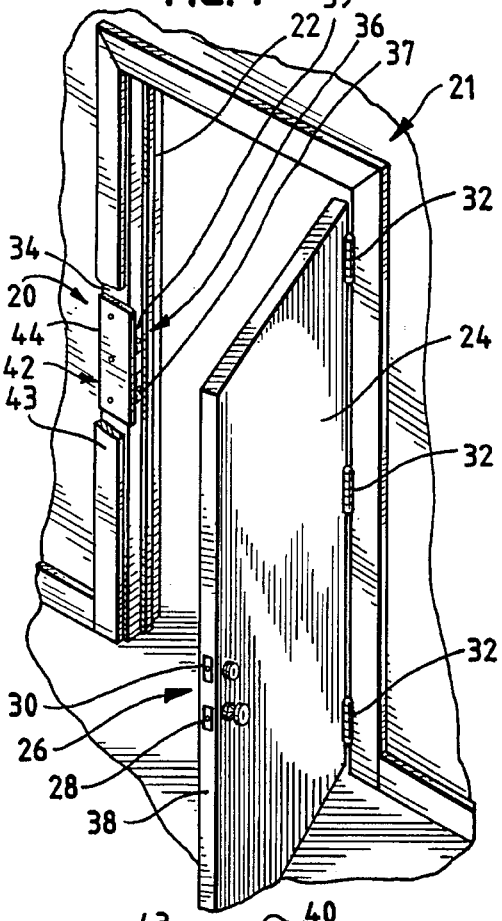
FIG. 1 is a perspective view of a door apparatus incorporating the security device of the invention.

Referring to FIG. 1, a security device, generally designated 20, of the invention is shown installed in a door apparatus, generally designated 21, comprising a door frame 22 and a door 24. The door apparatus 21 includes a latch, generally designated 26. The latch 26 includes a latch bolt 28 and/or a dead bolt 30. The door 24 is attached to the door frame 22 by a plurality of hinges 32.

As shown in FIG. 1, when the door 24 is in a open position, it is angularly displaced about the hinges 32 toward an inner side 34 of the door frame 22. The door frame 22 includes a latch receiving portion, generally designated 36, including a latch bolt receiving plate 37 that receives the latch bolt 28 and a dead bolt receiving plate 39 that receives the dead bolt 30 when the door is in a closed (and locked, in the case of the dead bolt 30) position. The latch bolt 28 and the dead bolt 30 extend from a latch edge 38 of the door 24 when the door 24 is in a closed position.

Figure 4:
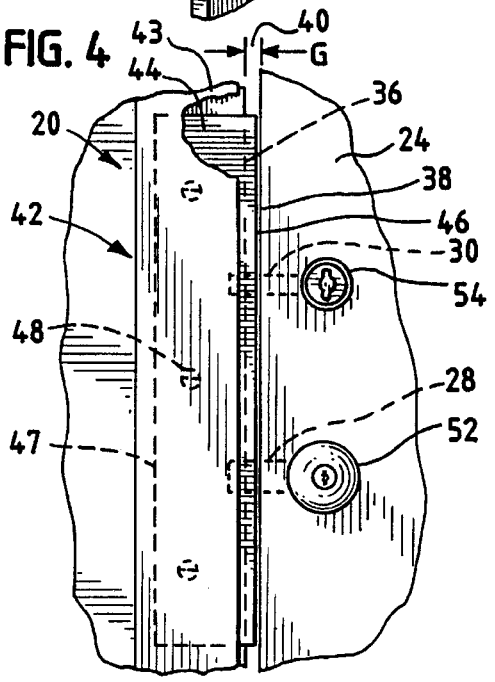
FIG. 4 is an elevational fragmentary view of the interior side of a door frame and door incorporating the security device of the invention.

Referring to FIG. 4, when the door 24 is in the closed position, abutting a stop 53 (shown in FIG. 3) on the door frame 22, the latch edge 38 of the door 24 and the latch receiving portion 36 of the door frame 22 define a gap 40 therebetween. The gap size G (FIG. 4) is typically in the range from about 1/16 inch (1.59 mm) to about 3/16 inch (4.76 mm). A door frame reinforcing member 42 comprising a plate 44 is secured to the inner side 34 of the door frame 22, beneath an interior trim piece 43. The interior trim piece 43 is preferably routed to accommodate the plate 44. The plate 44 includes a first edge 46 and an opposed second edge 47. The plate 44 is disposed on the door frame 22 such that the plate 44 extends into the gap 40 between the latch edge 38 of the door 24 and the latch receiving portion 36 of the door frame 22. As such, the first edge 46 of the plate 44 lies within the gap 40 when the door is closed, as shown in FIG. 4.

The latch bolt 28 is operated by a conventional doorknob mechanism 52. Similarly, the dead bolt 30 is operated by a conventional dead bolt mechanism 54.

Figure 2:
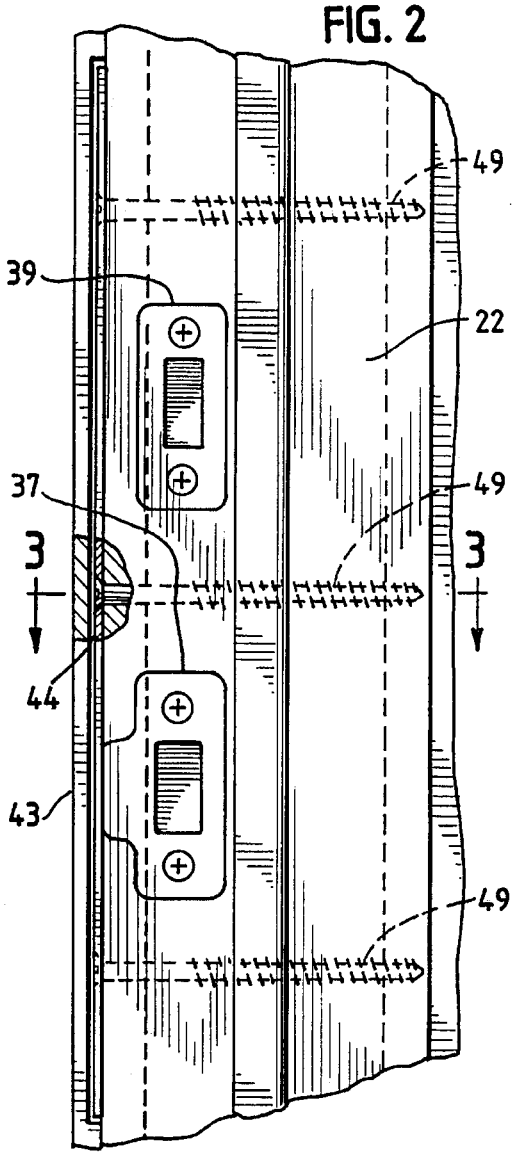
FIG. 2 is an elevational fragmentary view of a portion of a door frame incorporating the security device of the invention.

As best seen in FIG. 2, the plate 44 is illustratively secured to the door frame 22 by three screws 49 that each pass through a corresponding countersunk hole 48 in the plate 44. Although not shown in the drawings, any other suitable means may be used for securing the plate 44 to the door frame 22. For example, the plate 44 may be bolted, nailed, or glued to the door frame 22. Also, especially if the door frame 22 is metal, the plate 44 could be welded to the door frame 22 or the plate 44 could be integrally formed as part of the door frame 22.

Figure 3:
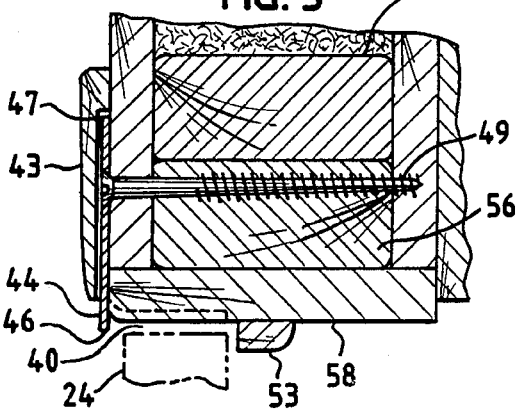
FIG. 3 is a fragmentary plan cross-sectional view taken along line 3—3 of FIG. 2.

FIG. 3 is a cross-sectional view of a wooden door frame 22 including a pair of two-by-four studs 56 and a door jamb 58. Preferably the plate 44 is secured to such a door frame 22 by the screws 49 that extend through one of the studs 56, as shown in FIG. 3.

Preferably, the holes 48 in the plate 44 are pre-drilled to simplify installation of the security device 20. The installer of the plate 44 need only position the plate 44 on the door frame 22 and mark the locations for drilling holes in the door frame 22 to accommodate the screws 49.

The security device 20, when installed in a door apparatus 21 as shown in FIGS. 1–4, will prevent the door 24 from being forcibly opened even if the latch receiving portion 36 of the door frame 22 is damaged during an attempt to forcibly open the door 24. Also, the plate 44 and screws 49 will reinforce the door frame 22 and help prevent the failure thereof. In addition, the plate 44, by extending into the gap 40, will prevent unauthorized opening of the door 24 even if the door 24 is bowed or bent inward toward the inner side 34 of the door frame 22 during an attempt to forcibly open the door 24, for example, while an intruder is attempting to kick in or pry open the door 24.

The plate 44 is preferably rectangular in shape and made of mild steel. The plate 44 typically will have a thickness in the range of from about 1/8 inch (3.175 mm) to about 1/4 inch (6.350 mm), inclusive. Preferably, the thickness of the plate 44 is about 1/8 inch (3.175 mm). The plate 44 typically will have a width, measured in the horizontal direction as shown in FIG. 4, in the range of from about two inches (5.08 cm) to about four inches (10.16 cm), inclusive. Preferably, the width of the plate 44 is about three inches (7.62 cm). The plate 44 typically will have a height, measured in the vertical direction as shown in FIG. 4, in the range of from about 12 inches (30.48 cm) to about 18 inches (45.72 cm), inclusive. Preferably, the height of the plate 44 is about 15 inches (38.10 cm). Also preferably, the holes 48 and the corresponding screws 49 have a diameter of about 5/16 inch (7.94 mm) and the screws 49 have a length of about three inches (7.62 cm). In order to prevent rotation of the plate 44 about a vertical axis, the holes 48 in the plate 44 are preferably spaced away from the second edge 47 by about one-third the width of the plate 44. This edge distance can vary by about 1/4 inch (6.35 mm) either way horizontally without significant adverse effects. The holes 48 should be spaced at least about one inch (2.54 cm) from the second edge 47 in order to prevent rotation.

Figure 5:
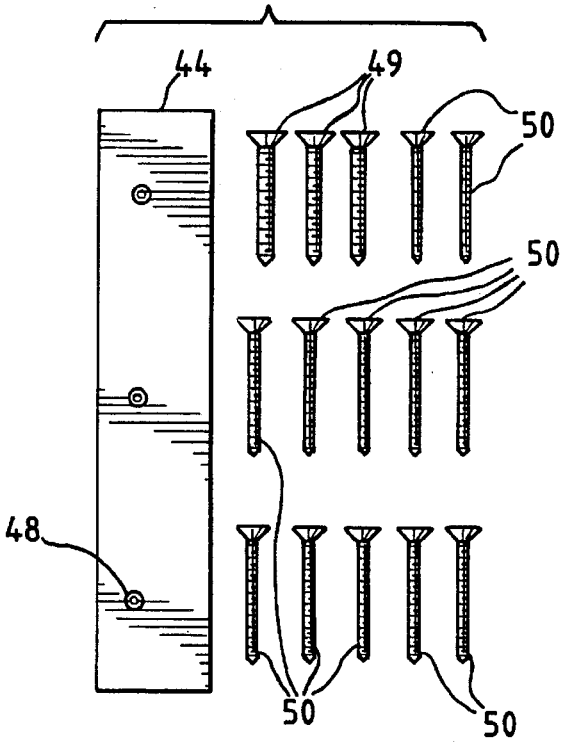
FIG. 5 is an elevational view of a kit comprising the security device of the invention.

FIG. 5 shows a kit comprising the plate 44 and three of the screws 49 and twelve #10 screws 50, each having a length of about three inches (7.62 cm). If desired, the kit also may include a drill bit (not shown). The components of the kit may be packaged together to facilitate installation of the security device 20 by a retail purchaser.

Figure 6:
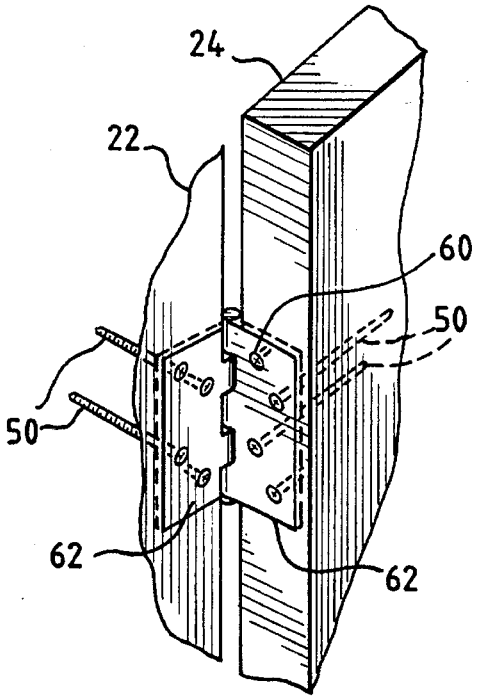
FIG. 6 is a perspective fragmentary view of the attachment screws of the kit of FIG. 5 installed in a door hinge.

The components of the kit may be used to install the security device 20 into an existing door apparatus 21 as follows. First, a portion of the trim 43 is removed, three holes are drilled in the door frame 22 and the plate 44 is secured to the door frame 22 with the three screws 49, as shown in FIG. 2. The holes in the door frame 22 should be located such that the first edge 46 of the plate 44 will extend into the gap 40 and so that the center hole 48 will be disposed between the latch bolt receiving plate 37 and the dead bolt receiving plate 39 when the plate 44 is installed on the door frame 22. The removed portion of trim 43 is then routed and replaced to cover the plate 44. If desired, appropriate portions of the door frame 22 and drywall or plaster (not shown) adjoining the door frame 22 may also be routed and spackling or joint compound may be used to better conceal the plate 44. Next, as shown in FIG. 6, each of two existing hinge screws 60 in hinge plates 62 of each hinge 32 is replaced with one of the #10 screws 50 that serves as a hinge reinforcing screw.

The #10 screws 50 extend further into the door 24 and door frame 22 than typical hinge screws 60. Therefore, the installation of #10 screws 50 into the hinges 32 provides further strength to the door apparatus. Alternatively, the #10 screws 50 may be installed in only one of the hinges 32 (e.g. the center hinge) instead of in all three hinges 60. Accordingly, the kit need only include four #10 screws 50.

Figure 7:
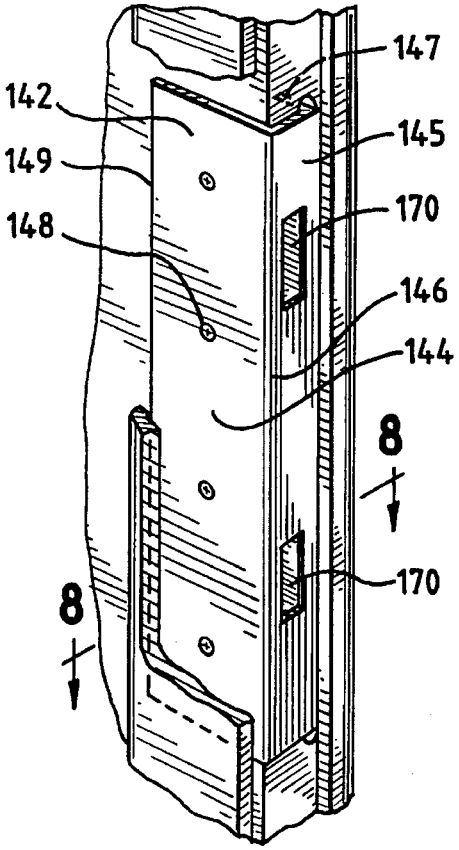
FIG. 7 is a fragmentary perspective view of a door frame incorporating an alternative embodiment of the security device of the invention.
Figure 8:
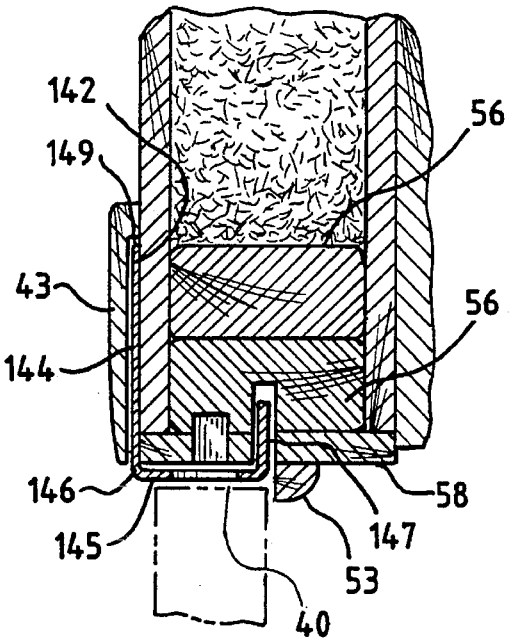
FIG. 8 is a fragmentary, cross-sectional plan view taken along line 8—8 of FIG. 7, on an enlarged scale.

An alternative embodiment of the invention is shown in FIGS. 7 and 8. This embodiment is described below to the extent it differs from the embodiment of FIGS. 1–4.

In the alternative embodiment, a door frame reinforcing member 142 includes an interior plate portion 144 disposed on the inner side 34 of the door frame 22. The door frame reinforcing member 142 further includes a latch plate reinforcing portion 145 that extends orthogonally from the interior plate portion 144 in the gap 40 and covers a portion of the door jamb 58 as shown in FIG. 8. Thus, the interior plate portion 144 includes a first edge 146, defined by the line of intersection of the interior plate portion 144 and the latch plate reinforcing portion 145, and a second edge 149 opposite thereto. The first edge 146 extends into the gap 40, as in the embodiment shown in FIGS. 1–4. The latch plate reinforcing portion 145 includes apertures 170 to accommodate the latch bolt 28 and the dead bolt 30. The door frame reinforcing member 142 still further includes a clamping portion 147 extending orthogonally from the latch plate reinforcing portion 145 through the door jamb 58 and into one of the studs 56 in the door frame 22. Preferably, the portions 144, 145, and 147 are integrally formed. However, the portions 144, 145, and 147 may be joined by any other suitable means, such as welding.

As shown in FIG. 8, installation of the door frame reinforcing member 142 into an existing door frame will require routing of the door jamb 58, the stud 56, and the trim 43, in order to accommodate the clamping portion 147. The door frame reinforcing member is secured to the door frame 22 with screws (not shown) that pass through countersunk holes 148 in the interior plate portion 144 of the door frame reinforcing member 142 and into one of the studs 56 of the door frame 22. Alternatively, the door frame reinforcing member 142 may be secured to the door frame 22 using any suitable means. In this respect, the installation of door frame reinforcing member 142 is substantially similar to the installation arrangement of the plate 44 of FIGS. 1–4.

Similarly to the plate 44 shown in FIGS. 1–4, each portion 144, 145, and 147 of the door frame reinforcing member 142 is preferably rectangular in shape and made of mild steel. Each portion 144, 145, and 147 typically has a thickness in the range of from about ⅛ inch (3.175 mm) to about ¼ inch (6.350 mm), inclusive, preferably about ⅛ inch (3.175 mm). The interior plate portion 144 typically has a width, measured in the horizontal direction as shown in FIG. 7, in the range of from about two inches (5.08 cm) to about four inches (10.16 cm), inclusive. Preferably, the width of the interior plate portion 144 is about three inches (7.62 cm).

The door frame reinforcing member 142 typically has a height, measured in the vertical direction as shown in FIG. 7, in the range of from about 12 inches (30.48 cm) to about 18 inches (45.72 cm), inclusive. Preferably, the height of the door frame reinforcing member 142 is about 15 inches (38.10 cm). In order to prevent rotation of the door frame reinforcing member 142 about the vertical, the holes 148 in the interior plate portion 144 are preferably spaced away from the second edge 149 by about one-third the width of the interior plate portion 144. This edge distance can vary by about ¼ inch (6.35 mm) either way horizontally without significant adverse effects. The holes 148 should be spaced at least about one inch (2.54 cm) from the second edge 149 in order to prevent rotation. The width of the latch plate reinforcing portion 145 may be in the range of from about 1½ inches (3.81 cm) to about two inches (5.08 cm), inclusive, preferably about 1¾ inches (4.45 cm). The width of the clamping portion 147 may be from about ½ inch (1.27 cm) to 1½ inches (3.81 cm), and is preferably about 1 inch (2.54 cm).

The foregoing detailed description is given for clearness of understanding only, and no unnecessary limitations should be understood therefrom, as modifications within the scope of the invention will be apparent to those skilled in the art.

I claim:

1. For use in combination with a door apparatus comprising a door frame, a door, a latch, and a hinge, said door frame including an inner side and a latch receiving portion including a latch bolt receiving plate, said door including a latch edge partially containing said latch, said latch edge and said latch bolt receiving plate defining a gap therebetween when said door is in a closed position, a security device comprising:

a door frame reinforcing member having a substantially planar interior plate portion disposable on said inner side of said door frame, said interior plate portion defining a first edge and extending from said door frame into said gap such that said first edge is disposed in said gap when said interior plate portion is disposed on said inner side of said door frame; and means for securing said interior plate portion to said door frame.

2. The security device of claim 1, wherein said door frame reinforcing member is made of mild steel.

3. The security device of claim 1, wherein said interior plate portion has a thickness in a range of from about ⅛ inch to about ¼ inch, inclusive.

4. The security device of claim 1, wherein said interior plate portion is substantially rectangular in shape.

5. The security device of claim 4, wherein:

said interior plate portion has a length along said first edge in a range of from about 12 inches to about 18 inches; and said interior plate portion has a width of from about two inches to about four inches, inclusive, defined by a distance between said first edge and a second edge opposite said first edge.

6. The security device of claim 1, wherein:

said interior plate portion has a plurality of holes; and said securing means comprises a plurality of screws or bolts adapted to pass through said holes and secure said interior plate portion to said door frame.

7. The security device of claim 6, wherein:

said interior plate portion has a width defined by a distance between said first edge and a second edge opposite said first edge; and said holes are spaced from said second edge by a distance approximately equal to one-third of said width of said interior plane portion.

8. The security device of claim 1, wherein said door frame reinforcing member further comprises a substantially planar latch plate reinforcing portion extending from said first edge and disposed substantially orthogonally to said interior plate portion.

9. The security device of claim 8, wherein said latch plate reinforcing portion includes one or more latch receiving apertures.

10. The security device of claim 8, wherein said door frame reinforcing member further comprises a substantially planar clamping portion extending from said latch plate reinforcing portion and disposed substantially parallel to said interior plate portion.

11. For use in combination with a door apparatus comprising a door free, a door, a latch, and a hinge, said door frame including an inner side and a latch receiving portion including a latch bolt receiving plate, said door including a latch edge partially containing said latch, said latch edge and said latch bolt receiving plate defining a gap therebetween when said door is in a closed position, a security device comprising:

a substantially flat plate disposable on said inner side of said door frame;

said plate defining a first edge, said plate extending from said door frame into said gap such that said first edge is disposed in said gap when said plate is disposed on said inner side of said door frame; and means for securing said plate to said door frame.

12. For use in combination with a door apparatus comprising a door frame, a door, a latch, and a hinge, said door frame including an inner side and a latch receiving portion including a latch bolt receiving plate, said door including a latch edge partially containing said latch, said latch edge and said latch bolt receiving plate defining a gap therebetween when said door is in a closed position, a security device comprising:

a door frame reinforcing member having a substantially planar interior plate portion disposable on said inner side of said door frame, said interior plate portion defining a first edge and extending from said door frame into said gap such that said first edge is disposed in said gap when said interior plate portion is disposed on said inner side of said door frame;

a substantially planar latch plate reinforcing portion extending from said first edge and disposed substantially orthogonally to said interior plate portion;

a substantially planar clamping portion extending from said latch plate reinforcing portion and disposed substantially parallel to said interior plate portion; and means for securing said interior plate portion to said door frame.

13. The security device of claim 12, wherein said latch plate reinforcing portion includes one or more latch receiving apertures.

14. A security device kit comprising:

a door free reinforcing member having a substantially planar interior plate portion disposable on an inner side of a door frame, said door frame including an inner side and a latch receiving portion including a latch bolt receiving plate, said interior plate portion defining a first edge and being adapted to extend from said door frame into a gap between said latch bolt receiving plate and a door, such that said first edge is disposed in said gap when said interior plate portion is disposed on said inner side of said door frame; and means for securing said interior plate portion to said door frame.

15. The kit of claim 14, further comprising:

means for securing a hinge to a hinge edge of said door and to a hinge receiving portion of said door frame.

16. The kit of claim 15 wherein said hinge securing means are hinge reinforcing screws.

17. The kit of claim 14 wherein:

said interior plate portion has a plurality of holes; and said plate securing means comprise a plurality of interior plate portion screws adapted to pass through said holes and secure said interior plate portion to said door frame.

18. The kit of claim 14, wherein said door frame reinforcing member further comprises a substantially planar latch plate reinforcing portion extending from said first edge and disposed substantially orthogonally to said interior plate portion.

19. The kit of claim 18, wherein said latch plate reinforcing portion includes one or more latch receiving apertures.

20. The kit of claim 18, wherein said door frame reinforcing member further comprises a substantially planar clamping portion extending from said latch plate reinforcing portion and disposed substantially parallel to said interior plate portion.

* * * * *